US008727467B2

(12) United States Patent
Nishihara

(10) Patent No.: US 8,727,467 B2
(45) Date of Patent: May 20, 2014

(54) LIQUID CONSUMPTION DEVICE AND METHOD

(71) Applicant: Seiko Epson Corporation, Tokyo (JP)

(72) Inventor: Yuichi Nishihara, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/728,114

(22) Filed: Dec. 27, 2012

(65) Prior Publication Data

US 2013/0222445 A1 Aug. 29, 2013

(30) Foreign Application Priority Data

Feb. 23, 2012 (JP) ..... 2012-037268
Feb. 23, 2012 (JP) ..... 2012-037272

(51) Int. Cl.
*B41J 2/195* (2006.01)

(52) U.S. Cl.
USPC ..... 347/7; 347/19; 347/86

(58) Field of Classification Search
CPC .... B41J 2/175; B41J 2/17566; B41J 2/17503; B41J 2/17506
USPC ..... 347/7, 19, 84–87
See application file for complete search history.

(56) References Cited

U.S. PATENT DOCUMENTS 5,975,665 A 11/1999 Torigoe et al.
6,969,137 B2 * 11/2005 Maeda ..... 347/7
7,044,590 B2 * 5/2006 Fujikawa et al. ..... 347/86
7,157,727 B2 * 1/2007 Kimura ..... 347/7
7,252,377 B2 * 8/2007 Nishioka et al. ..... 347/86

FOREIGN PATENT DOCUMENTS

JP 08-114488 A 5/1996
JP 2003-039699 A 2/2003

* cited by examiner

*Primary Examiner* — Juanita D Jackson
(74) *Attorney, Agent, or Firm* — Global IP Counselors, LLP

(57) ABSTRACT

A liquid consumption device includes a liquid container, a prism, a light emitting unit, a light receiving unit and a control unit. The prism is provided to the liquid container, and configured to receive light that is made incident from outside and to emit the incident light toward the outside according to a liquid residual state inside the liquid container. The control unit is configured to determine a threshold value of the liquid container for determining a light radiation volume by the light emitting part and/or the liquid residual state, based on a light volume of reflected light reflected by an outer surface of the prism and received by the light receiving unit upon radiation of the light by the light emitting unit. The control unit is configured to determine the liquid residual state based on a light volume of the light received by the light receiving unit.

12 Claims, 13 Drawing Sheets

151

| ESTIMATED RESIDUAL VOLUME | REFERENCE REFLECTION VOLUME | EMITTED LIGHT VOLUME | BOTTOM VALUE |
|---|---|---|---|

LIQUID CONSUMPTION DEVICE AND METHOD

CROSS-REFERENCE TO RELATED APPLICATIONS

This application claims priority to Japanese Patent Application No. 2012-037268 filed on Feb. 23, 2012 and Japanese Patent Application No. 2012-037272 filed on Feb. 23, 2012. The entire disclosures of Japanese Patent Application Nos. 2012-037268 and 2012-037272 are hereby incorporated herein by reference.

BACKGROUND

1. Technical Field

The present invention relates to a liquid consumption device and method.

2. Related Art

Typically, an ink cartridge which is a detachable liquid container is mounted on an inkjet method printing device which is an example of a liquid consumption device. To optically detect the residual state of the ink inside, there are ink cartridges for which a prism is equipped.

Regarding technology for detecting the ink residual state using a prism, for example, the printing device noted in Japanese Laid-Open Patent Application Publication No. H08-114488 uses a calibration reflecting unit provided on the carriage, and does calibration of output of a photo transistor constituted as a light receiving unit. In specific terms, light is radiated from an LED constituted as a light emitting unit on the calibration reflecting unit, the reflected light reflected by the calibration reflecting unit is received by the photo transistor, and calibration is performed by doing PWM control of the LED emitted light volume so that the output of the photo transistor is held within a fixed range.

SUMMARY

However, with an inkjet type printing device, there is the risk that the ink mist generated with spraying of ink will adhere to the calibration reflection plate, decreasing the light volume of reflected light. If that happens, the error range broadens between the light volume of the light received from the ink cartridge prism, and the light volume of the light received from the calibration reflecting unit. This kind of problem is not limited to inkjet method printing devices, but is a problem common to devices that detect the liquid residual state using a prism.

Considering the problems described above, the problem the present invention intends to solve is to provide in a liquid consumption device technology capable of determining with good precision the residual state of liquid inside a liquid container mounted in the liquid consumption device.

The present invention is able to address at least a portion of the problems described above by realizing the following modes or embodiments.

A liquid consumption device according to one aspect of the present invention includes a liquid container, a prism, a light emitting unit, a light receiving unit and a control unit. The liquid container is configured to supply liquid to the liquid consumption device. The prism is provided to the liquid container, and configured to receive light that is made incident from outside and to emit the incident light again toward the outside according to a liquid residual state inside the liquid container. The light emitting unit is configured to radiate the light to the prism. The light receiving unit is configured to receive the light emitted from the prism. The control unit is configured to control the light emitting unit to radiate the light, and to determine the liquid residual state based on a light volume of the light received by the light receiving unit. Before the liquid residual state is determined, the control unit is configured to determine a threshold value of the liquid container for determining at least one of a light radiation volume by the light emitting part and the liquid residual state, based on a light volume of reflected light that was reflected by an outer surface of the prism and received by the light receiving unit upon radiation of the light by the light emitting unit.

With this kind of constitution, the light volume of the light radiated from the light emitting unit is determined based on the light volume of the reflected light from the outer surface of the prism, so even if the prism becomes dirty, it is possible to ensure a suitable received light volume according to that dirtiness. Because of that, there is no occurrence of the past problem of the error range broadening between the light volume of the light received from the prism of the ink cartridge, and the light volume of the light received from the calibration reflecting unit. Thus, it is possible to detect with good precision the residual state of the liquid. Also, with this kind of constitution, the emitted light volume of the light emitting unit is adjusted based on the light volume of the reflected light from the prism equipped in a replaceable liquid container, so even if the prism becomes dirty, if the liquid inside the liquid container is consumed, the liquid container itself, specifically the prism itself, is replaced, so the dirtiness is resolved. Because of that, there is no risk of one way accumulation of dirt as there was with the prior art calibration reflecting unit, so it is possible to detect with good precision the residual state of the liquid over a long period.

Also, the threshold value for determining the residual state of the liquid is determined based on the light volume of reflected light from the outer surface of the prism, so it is possible to detect with good precision the residual state of the liquid. Also, with a liquid consumption device equipped with a plurality of liquid containers, it is possible to determine a threshold value for each liquid container, so it is not necessary to switch the emitted light volume of the light emitting unit individually for the plurality of liquid containers.

A liquid consumption device according to a second aspect is the liquid consumption device according to the first aspect, further including a plurality of the liquid containers. Prisms are preferably respectively provided in the plurality of liquid containers, and the control unit is preferably configured to determine a light volume of the light radiated from the light emitting unit based on a light volume of a plurality of reflected lights received from the prisms.

With this kind of constitution, it is possible to do uniform adjustment of the emitted light volume of the light emitting unit based on the light volume of the plurality of reflected lights from the plurality of prisms. Because of that, it is not necessary to adjust the emitted light volume for each prism, so it is possible to quickly perform a determination of the residual state of the liquid for the plurality of liquid containers.

A liquid consumption device according to a third aspect is the liquid consumption device according to the second aspect, wherein the control unit is preferably configured to determine the light volume of the light radiated from the light emitting unit based on a largest light volume among light volumes of the plurality of reflected lights received from the prisms.

With this kind of constitution, the light volume of the light radiated from the light emitting unit is adjusted based on the greatest light volume among the light volumes of the plurality of reflected lights received from each prism, so it is possible to suitably adjust the emitted light volume.

A liquid consumption device according to a fourth aspect is the liquid consumption device according to the second or third aspect, wherein the control unit is preferably configured to estimate a residual volume of the liquid in each of the liquid containers, and to determine the light volume of the light radiated from the light emitting unit based on the light volume of the reflected light from the prism equipped in the liquid container for which the estimated residual volume is a prescribed volume or greater.

With this kind of constitution, even in a case when it is not possible to suitably measure the reflected light from the prism when the residual volume of liquid is less than a prescribed volume, it is possible to suitably adjust the emitted light volume by the light emitting unit based on the light volume of the reflected light from the prism of the liquid containers for which the residual volume of liquid is the prescribed volume or greater.

A liquid consumption device according to a fifth aspect is the liquid consumption device according to any one of from the second to fourth aspects, wherein the control unit is preferably configured to estimate a residual volume of the liquid in each of the liquid containers, and to set the light volume of the light radiated from the light emitting unit to the light volume determined previously when all the estimated residual volumes are less than a prescribed volume.

With this kind of constitution, in a case when it is not possible to do suitable measurement of the reflected light from the prism when the residual volume of liquid is less than a prescribed volume, when the liquid of all the liquid containers is estimated to be less than the prescribed volume, the emitted light volume of the light emitting unit is set to the emitted light volume adjusted to previously. Because of that, even in cases when it is not possible to suitably measure the reflected light from all the prisms, it is possible to suitably set the light volume of the light emitting unit.

A liquid consumption device according to a sixth aspect is the liquid consumption device according to any of the first to fifth aspects, wherein the liquid container preferably includes a storage device, and, after the light volume of the light irradiated from the light emitting unit is determined, the control unit is preferably configured to write information indicative of the determined light volume to the storage device.

With this kind of constitution, even in a case when a liquid container is mounted on a different liquid consumption device, it is possible to convey a suitable emitted light volume for that liquid container to the different liquid consumption device.

A liquid consumption device according to a seventh aspect is the liquid consumption device according to the first aspect, wherein the control unit is preferably configured to determine the liquid residual state based on the light volume of the light received by the light receiving unit and on the threshold value.

A liquid consumption device according to an eighth aspect is the liquid consumption device according to the first aspect, wherein the control unit is preferably configured to estimate a residual volume of the liquid in the liquid container, and to determine the threshold value when the estimated residual volume is a prescribed volume or greater.

With this kind of constitution, when it is possible to do suitable measurement of the reflected light from the prism for which the residual volume of liquid is a prescribed volume or greater, it is possible to perform determining of the threshold value.

A liquid consumption device according to a ninth aspect is the liquid consumption device according to the first or eighth aspect, wherein the liquid container preferably includes a storage device, the control unit is preferably configured to record the light volume of the reflected light received by the light receiving unit in the storage device, and the control unit is preferably configured to estimate a residual volume of the liquid in the liquid container, and when the estimated residual volume is less than a prescribed volume, the control unit is preferably configured to estimate the light volume of the reflected light from the prism that the liquid container is equipped with based on a previous light volume of the reflected light recorded in the storage device, and to determine the threshold value based on the estimated light volume.

With this kind of constitution, when the residual volume of liquid is estimated to be a prescribed volume or less, the light volume of the reflected light from the prism is estimated based on the light volume of the reflected light recorded in the storage device, and the threshold value is determined. Because of that, even in a case when suitable measurement is not possible for the reflected light from the prism when the residual volume of the liquid is less than the prescribed value, it is possible to set a suitable threshold value.

A liquid consumption device according to a tenth aspect is the liquid consumption device according to the ninth aspect, further comprising a reflecting unit, wherein the control unit is preferably configured to control the light emitting unit to radiate light on the reflecting unit at a prescribed light volume, and to estimate a reference reflection volume by receiving reflected light reflected by the reflecting unit using the light receiving unit, the control unit is preferably further configured to record in the storage device a volume of emitted light of the light emitting unit and the reference reflection volume, the control unit is preferably configured to, when the estimated residual volume is less than the prescribed volume, estimate the light volume of the reflected light from the prism of the liquid container based on a light volume of a previous reflected light stored in the storage device, a current emitted light volume of the light emitting unit, a previous light volume of the light emitting unit stored in the storage device, a current reference reflection volume, and a previous reference reflection volume stored in the storage device.

With this kind of constitution, even in a case when it is not possible to suitably measure the reflected light from the prism when the residual volume of liquid is less than a prescribed volume, it is possible to estimate the light volume of reflected light with good precision based on various parameters recorded in the storage device.

A liquid consumption device according to an eleventh aspect is the liquid consumption device according to the first aspect, wherein, after the light radiation volume by the light emitting unit is determined, the control unit is preferably configured to receive at the light receiving unit the reflected light reflected by the outer surface of the prism accompanying the light irradiation by the light emitting unit at the determined light radiation volume, and to determine the threshold value of the liquid container for determining the liquid residual state based on the light volume of the received reflected light.

A liquid consumption device according to a twelfth aspect is the liquid consumption device according to the first aspect, further comprising a plurality of the liquid containers. Prisms are preferably respectively equipped in the plurality of liquid containers, the control unit is preferably configured to determine a light volume of light common to the plurality of liquid containers, and the control unit is preferably configured to determine the threshold value of each of the liquid containers based on the light volume of the plurality of reflected lights received from the prisms.

In addition to the constitution as a liquid consumption device described above, the present invention can also be realized as a method for determining a liquid residual state for a liquid consumption device, or as a computer program for realizing that method. The computer program may also be recorded in a computer readable recording medium.

BRIEF DESCRIPTION OF THE DRAWINGS

Referring now to the attached drawings which form a part of this original disclosure.

DETAILED DESCRIPTION OF EXEMPLARY EMBODIMENTS

A. Device Configuration

Figure 1:
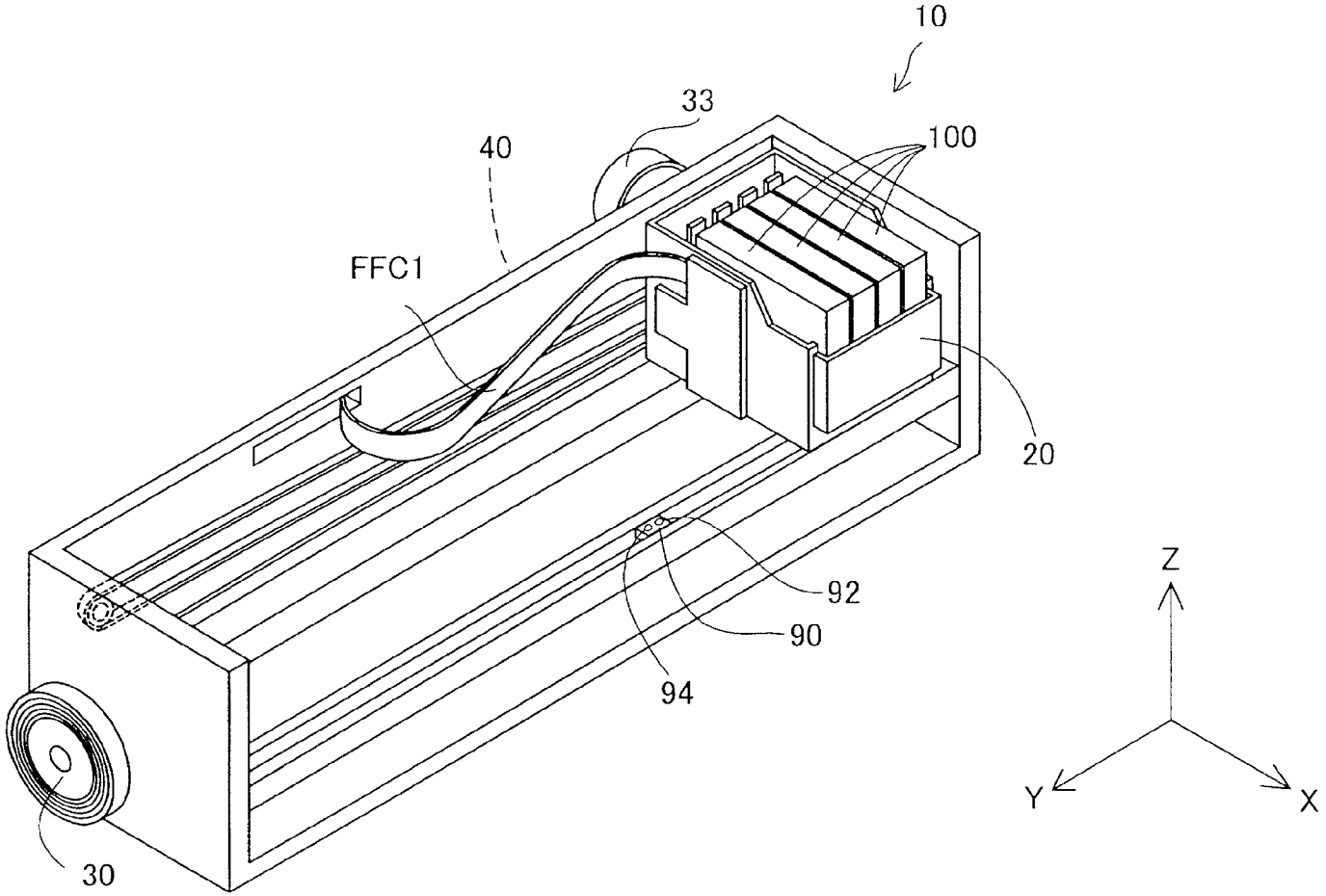
FIG. 1 is a perspective view showing the major parts of a printing device as a first embodiment of the present invention.
Figure 2:
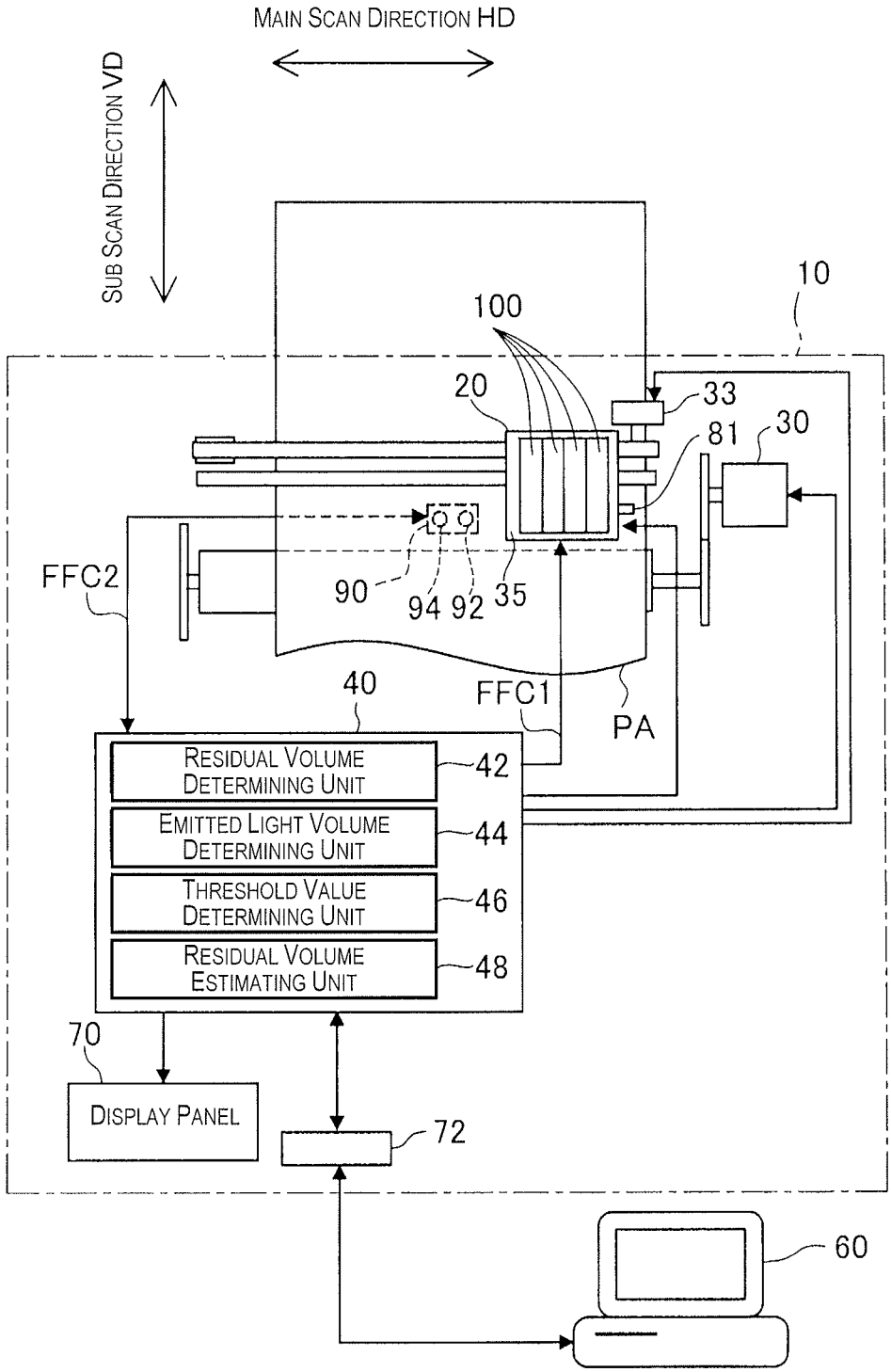
FIG. 2 is a schematic diagram of a printing device.

FIG. 1 is a perspective view showing the major parts of the printing device 10 as an embodiment of the present invention. FIG. 2 is a schematic diagram of the printing device 10. The XYZ axes that are orthogonal to each other are depicted in FIG. 1. The XYZ axes are also added as necessary in drawings hereafter. With this embodiment, with the use orientation of the printing device 10, the Z axis direction is the vertical direction, and the printing device X direction surface is the front surface. The main scan direction of the printing device 10 is the Y axis direction, and the sub scan direction is the X axis direction.

The printing device 10 as a liquid consumption device is equipped with a plurality of ink cartridges 100 as liquid containers in which are held one color each of inks such as cyan, magenta, yellow, black and the like, a carriage 20 in which the ink cartridges 100 are mounted, a carriage motor 33 for driving the carriage 20 in the main scan direction HD, a detection unit 90 for detecting the residual state of the ink arranged in parallel with the main scan direction HD of the carriage 20, a paper feed motor 30 for transporting a printing medium PA in the sub scan direction VD, a printing head 35 for ejecting ink supplied from the ink cartridge 100 placed in the carriage 20, and a control unit 40 for controlling the carriage motor 33, the paper feed motor 30, and the printing head 35 based on the printing data received from a computer 60 or the like connected via a prescribed interface 72 to perform printing. A display panel 70 for displaying the operating state of the printing device 10 or the like is connected to the control unit 40. Also, the carriage 20 is connected to the control unit 40 via a cable FFC1, and the detection unit 90 is connected via a cable FFC2.

Figure 3:
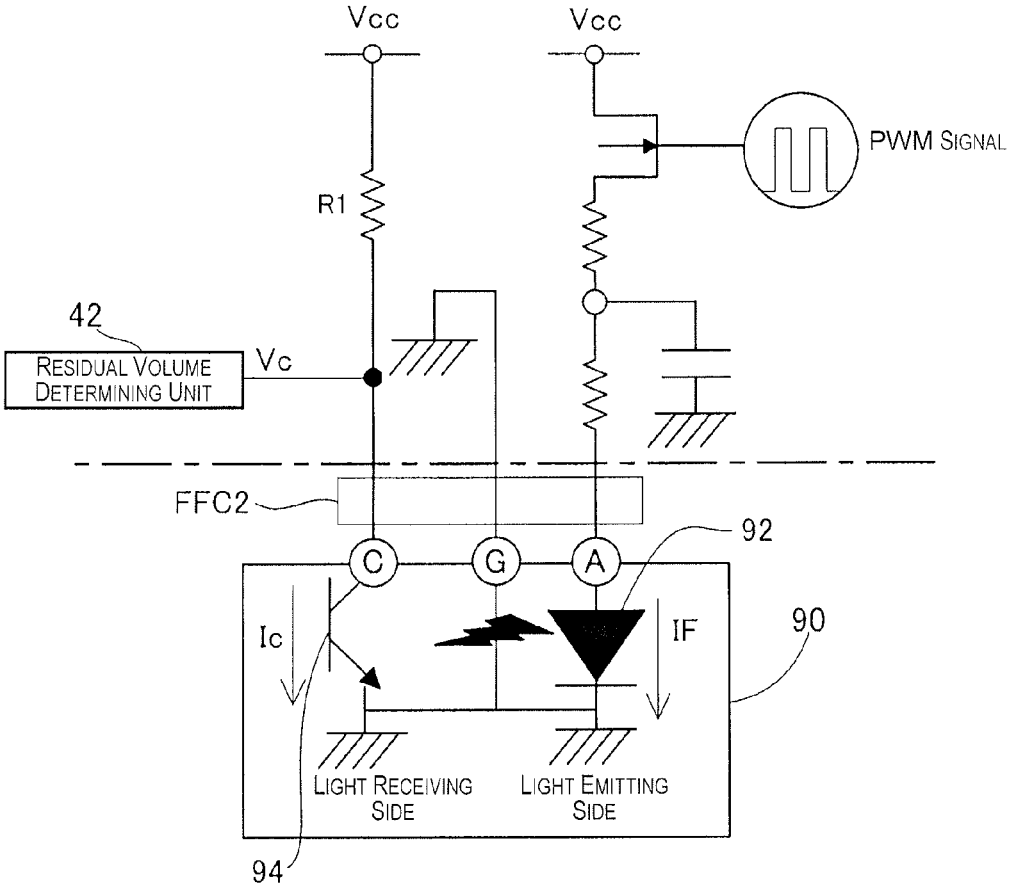
FIG. 3 is an explanatory drawing showing the electrical configuration of the detection unit.

FIG. 3 is an explanatory drawing showing the electrical configuration of the detection unit 90. The detection unit 90 is constituted as a reflective type photo interrupter, and is equipped with a light emitting unit 92 and a light receiving unit 94. The detection unit 90 is equipped with an LED as the light emitting unit 92, and is equipped with a photo transistor as the light receiving unit 94. The emitter terminal of the photo transistor is grounded, and the collector terminal is connected to a power supply potential Vcc via a resistor R1. A potential between the resistor R1 and the collector terminal is input to a residual volume determining unit 42 as the output voltage Vc of the detection unit 90. The emitted light volume of the light radiated by the light emitting unit 92 is set by the duty ratio (ratio of on time and off time) of the PWM (Pulse Width Modulation) signal applied to the light emitting unit 92 being adjusted by the control unit 40. When the light radiated from the light emitting unit 92 is reflected by the prism within the ink cartridge 100 described later and received at the light receiving unit 94, the output voltage Vc according to that received light volume is input to the residual volume determining unit 42 described later. With this embodiment, the greater the amount of light volume received by the light receiving unit 94, the lower the output voltage Vc output from the detection unit 90.

As shown in FIG. 1 and FIG. 2, the light emitting unit 92 and the light receiving unit 94 that the detection unit 90 is equipped with are arranged aligned in parallel with the main scan direction HD (Y axis direction) in which the carriage 20 moves. Also, the light emitting unit 92 and the light receiving unit 94 are arranged so as to face opposite the prism 170 inside the ink cartridge 100 via the aperture part 21 that the carriage 20 is equipped with when the carriage 20 is moved by the carriage motor 33 and positioned above the detection unit 90. We will describe the aperture part 21 and the prism 170 later.

The control unit 40 (FIG. 2) is equipped with a CPU, ROM, and RAM. The CPU functions as the residual volume determining unit 42, the emitted light volume determining unit 44, the threshold value determining unit 46, and the residual volume estimating unit 48 by expanding in the RAM a control program stored in advance in the ROM and executing it. Also, the control unit 40 controls printing on the printing medium PA by controlling the paper feed motor 30, the carriage motor 33, and the printing head 35.

The residual volume determining unit 42 determines the residual status of the ink within the ink cartridge 100. The residual volume determining unit 42 fetches the output voltage Vc when the ink cartridge 100 is at a prescribed position in relation to the detection unit 90 through the cable FFC2, and based on that output voltage Vc and a prescribed threshold value, determines whether the ink within the ink cartridge 100 is a prescribed volume or less. Hereafter, the ink being at a prescribed volume or less will also be referred to as "ink near end."

The emitted light volume determining unit 44 determines the emitted light volume of light radiated by the light emitting unit 92. The control unit 40 does PWM control of the light emitting unit 92 to perform light modulation based on the emitted light volume determined by this emitted light volume determining unit 44.

The threshold value determining unit 46 determines the threshold value used by the residual volume determining unit 42 to determine ink near end, and the processing contents for determining the threshold value will be described later.

The residual volume estimating unit 48 estimates the residual volume of ink within each ink cartridge 100. The ink residual volume can be estimated by counting the number of ink drops sprayed from the printing head 35, calculating the ink use volume by integrating the counted number of ink drops with the mass per ink drop, and subtracting the calculated ink use volume from the initial filled volume of ink within the ink cartridge 100. The residual volume estimating unit 48 records as appropriate the residual volume of ink estimated in this way in the storage device 151 that each ink cartridge 100 is equipped with. The residual volume estimating unit 48, for example when activating the printing device 10, fetches the residual volume of ink from the storage device 151 of each ink cartridge 100 and stores it in the RAM within the control unit 40, and during the time the power is turned on, the value within this RAM is updated along with execution of printing or cleaning of the printing head 35. Then, for example, when the power of the printing device 10 is off, or when the ink cartridge 100 is being replaced, or each time a prescribed ink volume is consumed, an updated estimated residual volume is written back to the storage device 151 of the ink cartridge 100.

Figures 4, 5:
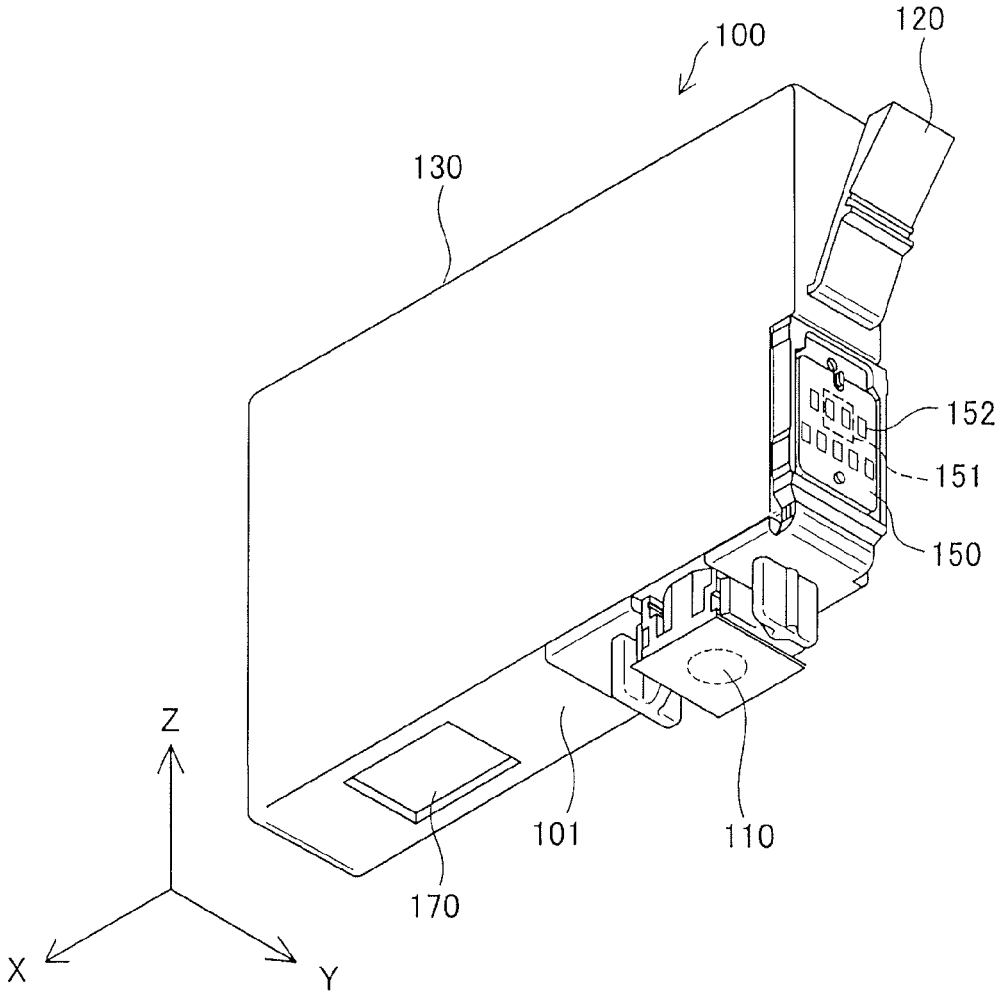
FIG. 4 is a perspective view of the ink cartridge.
FIG. 5 is an explanatory drawing showing the information recorded in the storage device.

FIG. 4. is a perspective view of the ink cartridge 100. The ink cartridge 100 is equipped with a roughly rectangular solid shaped ink housing unit 130 which houses ink inside it, a circuit substrate 150 (hereafter also simply called "substrate"), and a lever 120 for attaching and detaching the ink cartridge 100 on the carriage 20. The substrate 150 is provided on the −Z side of the −X side surface of the ink housing unit 130, and the lever 120 is provided on the +Z side of the −X side surface of the ink housing unit 130. An isosceles right triangle cylinder shaped prism 170 is arranged at the bottom part of the ink housing unit 130. The bottom surface of the prism 170 is exposed from the bottom surface 101 which constitutes the −Z side surface of the ink cartridge 100. When the ink cartridge 100 is mounted on the carriage 20, an ink supply port 110 in which an ink receiving needle is inserted which is provided on the carriage 20 is formed on the bottom surface 101 of the ink cartridge 100. In the state before use, the ink supply port 110 is sealed by a film. When the ink cartridge 100 is mounted from above on the carriage 20, the film is broken by the ink receiving needle, and ink is supplied from the ink housing unit 130 to the printing head 35 through the ink supply port 110.

The storage device 151 for recording information related to the ink cartridge 100 is mounted on the back surface of the substrate 150. A plurality of terminals 152 electrically connected to the storage device 151 are arranged on the front surface of the substrate 150. When the ink cartridge 100 is mounted in the carriage 20, the plurality of terminals 152 are in electrical contact with the plurality of main unit side terminals (not illustrated) provided on the carriage 20. The plurality of main unit side terminals are electrically connected to the control unit 40 by the cable FFC1. Because of that, when the ink cartridge 100 is mounted in the carriage 20, the control unit 40 is electrically connected to the storage device 151, and reading and writing of data to the storage device 151 is possible. As the storage device 151, it is possible to use non-volatile memory such as EEPROM or the like, for example.

FIG. 5 is an explanatory drawing showing information recorded in the storage device 151. As shown in FIG. 5, with this embodiment, the ink estimated residual volume, the reference reflection volume, the emitted light volume, and the bottom value are rewriteably recorded in non-volatile form to the storage device 151. The estimated residual volume of ink is expressed by mass, and the reference reflection volume and bottom value are expressed as output voltage values from the detection unit 90. Also, the emitted light volume is expressed by data indicating the duty ratio of the PWM signals applied to the light emitting unit 92. These values will be described in detail later.

Figure 6:
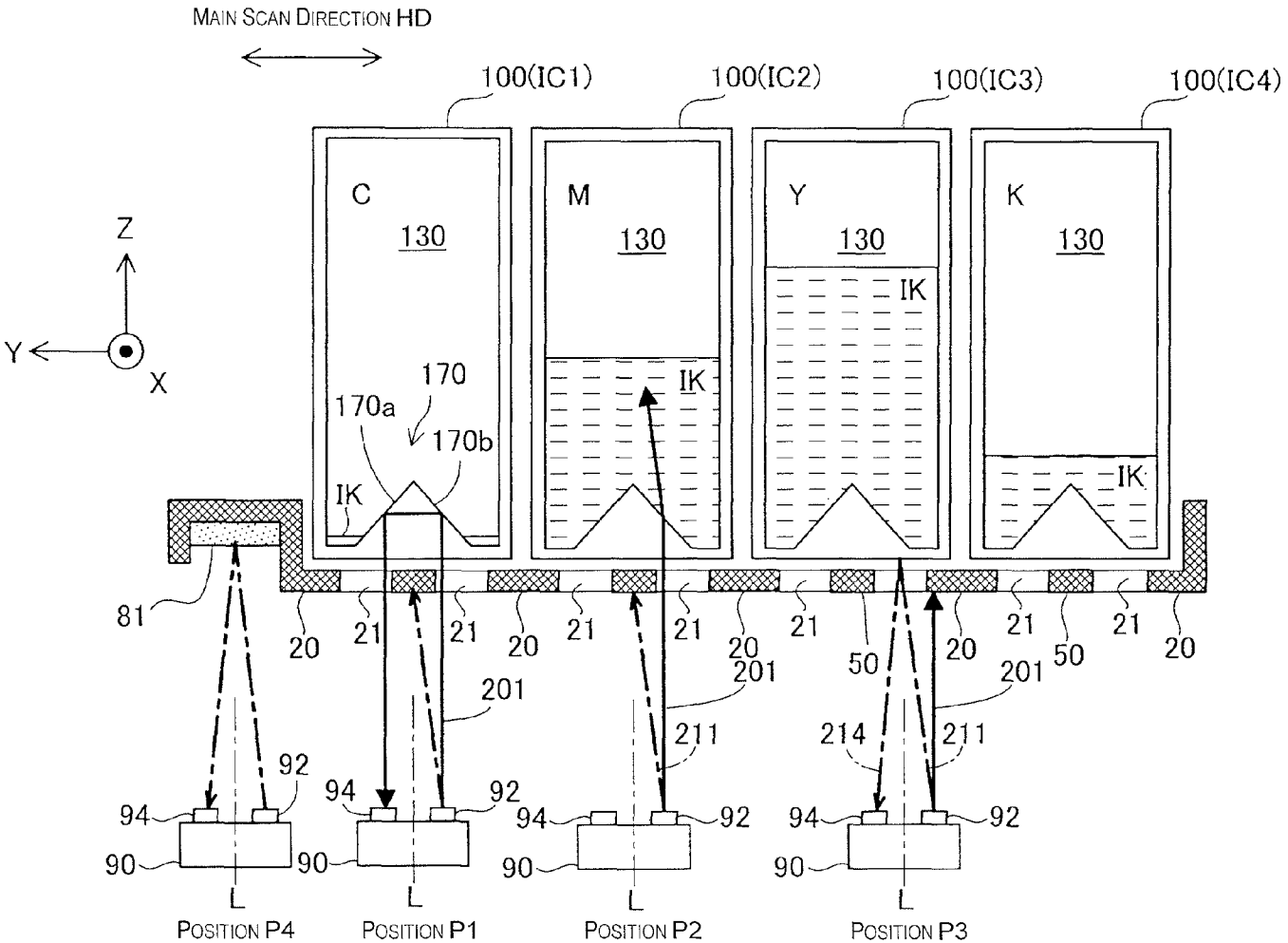
FIG. 6 is a drawing showing the state when an ink cartridge is mounted in a carriage.

FIG. 6 is a drawing showing the state with four ink cartridges 100 mounted in the carriage 20. This FIG. 6 shows a typical view of the YZ cross section of the ink cartridge 100 and the carriage 20. The prism 170 provided inside the ink housing unit 130 is an isosceles right triangular transparent member for which the vertical angle is formed by two inclined surfaces 170*a* and 170*b*. The prism 170 is formed using polypropylene, for example. With the prism 170, the reflected state of the light made incident from the light emitting unit 92 (described in detail later) differs by the index of refraction of the fluid (ink or air) in contact with the inclined surfaces 170*a* and 170*b*.

At the bottom surface of the carriage 20, at the part facing opposite the prism 170 of the ink cartridge 100 when the ink cartridge 100 is mounted in the carriage 20, an aperture part 21 is provided for each ink cartridge 100. The aperture part 21 is provided at a location facing opposite the light emitting unit 92 and the light receiving unit 94 that the detection unit 90 is equipped with when the prism 170 is positioned directly above the detection unit 90 by the back and forth movement of the carriage 20. A light blocking mask 50 is provided along the direction parallel to the ridge line forming the vertical angle of the prism 170 at the center of the respective aperture parts 21 of the carriage 20. The light blocking mask 50 is formed as an integral unit with the carriage 20. The light blocking mask 50 is constituted using a material that absorbs light and is different from the material of the prism 170, and with this embodiment, is polystyrene that is colored black.

The carriage 20 moves in the main scan direction HD above the detection unit 90 fixed to the printing device 10 by being driven by the carriage motor 33. By moving the carriage 20 above the detection unit 90, the positional relationship of the carriage 20 and the detection unit 90 changes relatively such as with position P1, position P2, position P3, and position P4 shown in FIG. 6, for example.

At the position P1 shown in FIG. 6, the detection unit 90 faces opposite the prism 170 of the ink cartridge IC1 for which the ink is almost used up (specifically, the ink cartridge 100 for which ink is in a further consumed state from ink near end). In specific terms, at the position P1, the center L of the light emitting unit 92 and the light receiving unit 94 almost matches the position of the vertical angle of the prism 170. When the ink within the ink housing unit 130 is almost used up, the inclined surfaces 170*a* and 170*b* of the prism 170 are in contact with air. Because of that, when the light 201 radiated toward the prism 170 from the light emitting unit 92 is made incident within the prism 170 from the bottom surface of the prism 170, these are respectively fully reflected at the inclined surface 170*a* and the inclined surface 170*b* due to the difference in the index of refraction of the prism 170 and air. Having done that, the light emitted from the light emitting unit 92 has its progression direction inverted by 180 degrees, and the light is emitted to the outside from the bottom surface of the prism 170 and received by the light receiving unit 94. With this embodiment, from the light emitting unit 92, not only the light at a vertical angle upward (+Z direction), but also light having a prescribed broadening are radiated. However, at the position P1, of the light radiated from the light emitting unit 92, the light not made incident on the prism 170 is blocked by the light blocking mask 150 and the bottom surface of the carriage 20, so the light other than the light emitted through the inside of the prism 170 is almost not made incident at all on the light receiving unit 94.

At the position P2 shown in FIG. 6, the same as with position P1, the center L of the light emitting unit 92 and the light receiving unit 94 almost match the position of the vertical angle of the prism 170. However, at the position P2, the detection unit 90 faces opposite the prism 170 of the ink cartridge 100 for which the ink remains at a position higher than the surface at which light emitted from the light emitting unit 92 of the detection unit 90 of the prism 170 is received. In this way, when the ink IK exists within the ink housing unit 130 at a level at which the surface at which the light from the light emitting unit 92 of the inclined surface 170*b* of the prism 170 is in contact with the ink IK, the index of refraction of the prism 170 and the ink IK are almost the same, so the major part of the light 201 radiated from the light emitting unit 92 toward the prism 170 is transmitted through the inclined surface 170*b* and is absorbed within the ink IK. Also, of the light radiated from the light emitting unit 92, the light 211 that is not made incident on the prism 170 is blocked by the light blocking mask 50 and the bottom surface of the carriage 20. Because of that, at the position P2, the light emitted from the light emitting unit 92 is almost not made incident at all on the light receiving unit 94.

At the position P3 shown in FIG. 6, the center L of the light emitting unit 92 and the light receiving unit 94 faces opposite the aperture part 21. With this kind of positional relationship, regardless of whether or not there is ink, a portion of the light radiated from the light emitting unit 92 is reflected by the outer surface (bottom surface) facing opposite the detection unit 90 of the prism 170, and is received by the light receiving unit 94. Because of that, when there is a large volume of light reflected directly by the bottom surface of the prism 170 due to skewing of the detection timing by the individual difference or the like of the attachment position of the detection unit 90 and the carriage 20, the position of the aperture part 21 provided on the carriage 20, and the position at which the prism 170 is provided, even in a case when there is sufficient ink remaining, there is the risk of this being judged as ink near end.

At the position P4 shown in FIG. 6, the center L of the light emitting unit 92 and the light receiving unit 94 faces opposite the reflection plate 81 provided at one part of the carriage 20. The reflection plate 81 is formed by a mirror that can reflect all of the incident light. When the reflection plate 81 is positioned right above the detection unit 90, when a portion of the light radiated from the light emitting unit 92 is made incident on the reflection plate, that light is reflected by the reflection plate 81, and made incident on the light receiving unit 94. With this embodiment, the control unit 40, by using this reflection plate 81, measures as the reference reflection volume the light volume of the reflected light in relation to the reference emitted light volume (e.g. 50% duty ratio emitted light volume or maximum emitted light volume). We will describe how this reference reflection volume is used.

Figure 7:
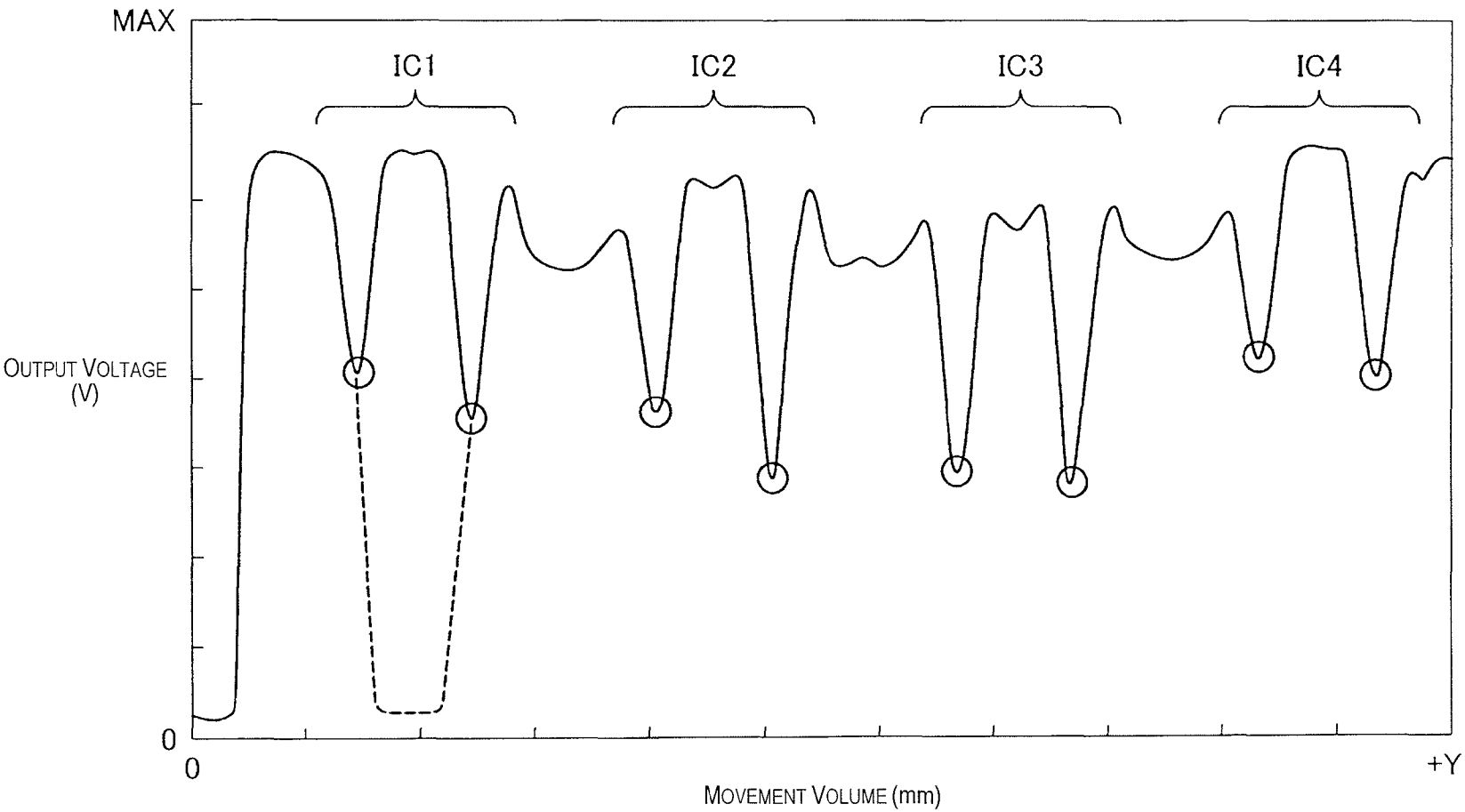
FIG. 7 is a graph showing an example of the results of measuring the output voltage from the detection unit.

FIG. 7 is a graph showing an example of the results of measuring the output voltage from the detection unit 90. This graph was obtained my measuring the output voltage from the detection unit 90 while moving the carriage 20 in the +Y direction from the position P4 shown in FIG. 6 while having the light emitting unit 92 emit light, in a state for which all the ink cartridges 100 are filled with ink. The horizontal axis of this graph shows the movement volume of the carriage 20 in the +Y direction, and the vertical axis shows the output voltage of the detection unit 90. As described using FIG. 3, with this embodiment, the greater the volume of light received by the light receiving unit 94, the lower the output voltage of the detection unit 90. As shown in FIG. 7, when the movement volume of the carriage 20 is zero, the detection unit 90 is facing opposite the reflection plate 81, so the volume of light received by the light receiving unit 94 is greater than when there is no reflection, and the output voltage of the light receiving unit 94 approaches zero. When the carriage 20 moves from position P4 in the +Y direction, after the output voltage rises once, the output voltage decreases. This is because the reflected light from the bottom surface of the prism 170 is received by the light receiving unit 94 by radiation of light on the aperture part 21 under the ink cartridge IC1. After that, when light is blocked by the light blocking mask 50 by the carriage 20 being moved, the output voltage of the detection unit 90 rises. Then, when light is again radiated on the aperture part 21, the reflected light from the bottom surface of the prism 170 is again received by the light receiving unit 94, and the output voltage decreases. With this embodiment, the light blocking mask 50 is provided at the center of the aperture part 21, so each time one prism 170 passes above the detection unit 90, a bottom for which the output voltage drops significantly (circle marks in the drawing) appears in two locations. Because of that, when the carriage 20 moves in the +Y direction, two bottom locations each for which the output voltage drops are measured respectively for each ink cartridge 100. Referring to FIG. 7, the output voltage which is the bottom differs for each ink cartridge 100. The main cause of this is that dirt adhered to the bottom surface of the prism 170 (e.g. ink mist) or scratches are different for each ink cartridge 100 because there is variation in the replacement period for the ink cartridge 100. When the ink within the ink cartridge 100 is less than the ink near end state, when the center L of the detection unit 90 and the vertical angle of the prism 170 match, the light from the light emitting unit 90 made incident on the prism 170 is reflected within the prism 170 and the reflected light is received by the light receiving unit 94, so as shown by the dotted line in the graph, the output voltage between the two bottoms is greatly decreased.

B. Ink Near End Detection Processing

Figure 8:
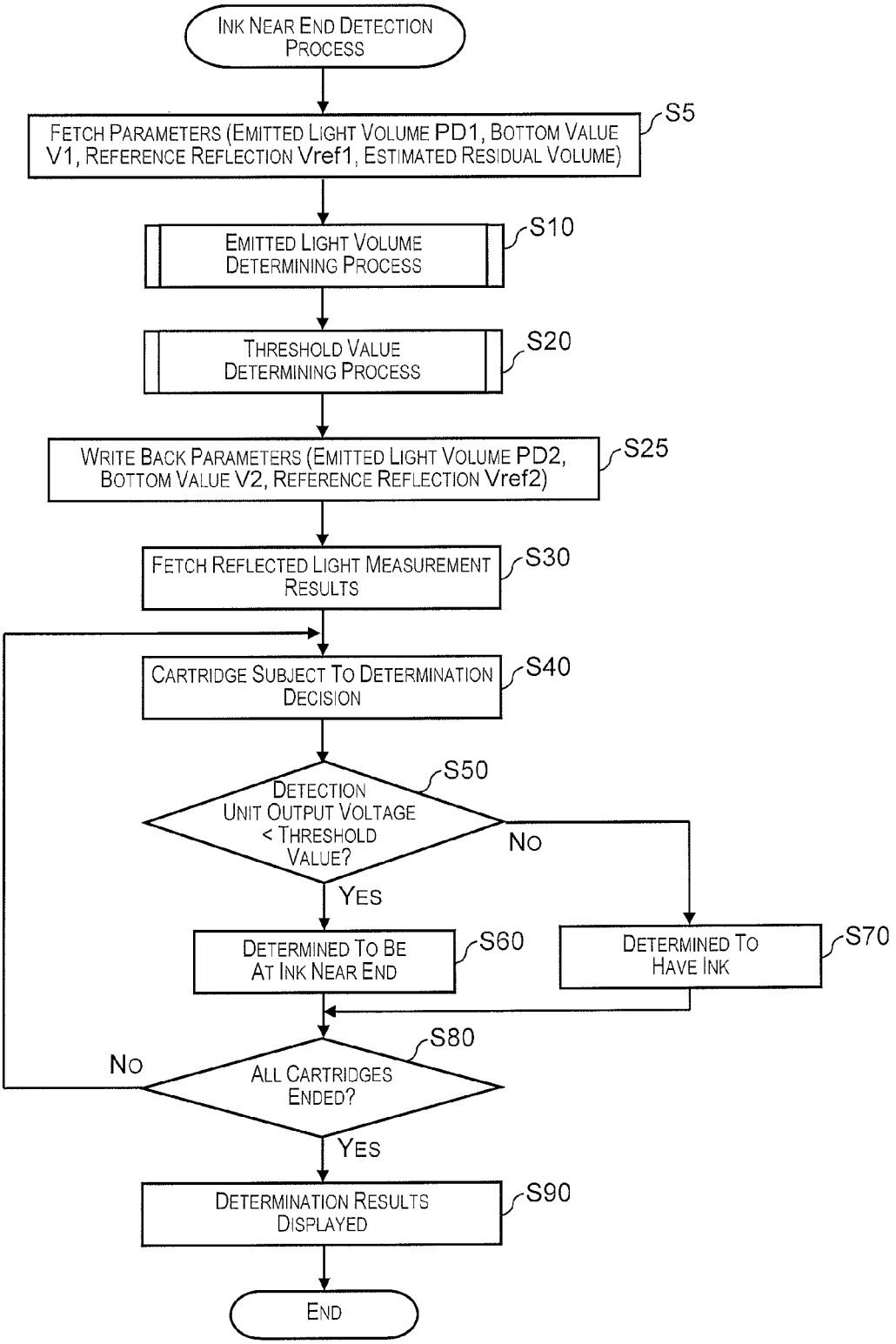
FIG. 8 is a flow chart of the ink near end detection process.

FIG. 8 is a flow chart of the ink near end detection process executed by the control unit 40. The ink near end detection process is executed at various timings, such as when activating the printing device 10, during replacement of the ink cartridge 100, or when the residual volume of ink determined by the residual volume estimating unit 48 is a prescribed volume or less, for example. When the ink near end detection process starts, first, the control unit 40 fetches each parameter used with the process thereafter (step S5). In specific terms, the emitted light volume PD1 determined by the previous ink near end detection process, the bottom value V1, and the reference reflection volume Vref1 are fetched from the storage device 151 of each ink cartridge 100, and the ink estimated residual volume of each ink cartridge 100 is fetched from the RAM. The ink estimated residual volume is read to the RAM of the control unit 40 from the storage device 151 of each ink cartridge 100 by the residual volume estimating unit 48 when the power of the printing device 10 is turned on and sequentially updated, so the control unit 40 is able to fetch the ink estimated residual volume from its own RAM. When these parameters are fetched, the emitted light volume determining process is executed by the emitted light volume determining unit 44 (step S10). With this emitted light volume determining process, the new emitted light volume PD2 of the light emitting unit 92 and the bottom value V2 corresponding to that emitted light volume PD2 are determined based on the light volume of the light reflected by the bottom surface of the prism 170 of each ink cartridge 100. The details of the emitted light volume determining process will be described later.

With the emitted light volume determining process, when the emitted light volume PD2 and the bottom value V2 are determined, next, the threshold value determining process is executed by the threshold value determining unit 46 (step S20). With this threshold value determining process, together with measuring a new reference reflection volume Vref2, based on the light volume of the light reflected by the bottom surface of the prism 170 of each ink cartridge 100, the threshold value used for determining ink near end is determined for each ink cartridge 100. The details of the threshold value determining process will be described later.

When the emitted light volume determining process and the threshold value determining process are executed, the control unit 40 writes back to the storage device 151 of each ink cartridge 100 (step S25) each of the new parameters determined by these processes, specifically, the new emitted light volume PD2, the new bottom value V2, and the new reference reflection volume Vref2. In specific terms, the control unit 40 writes the new emitted light volume PD2 and the new reference reflection volume Vref2 in common to each storage device 151, and the new bottom values V2 are written respectively to the storage device 151 of the corresponding ink cartridge 100.

When each parameter is written back to the storage device 151, by having the light emitting unit 92 emit light based on the emitted light volume determined by the emitted light volume determining process of step S10 and moving the carriage 20 so as to pass over the detection unit 90, the residual volume determining unit 42 has the output voltage corresponding to the light volume of the reflected light from the prism 170 that each ink cartridge 100 is equipped with measured by the detection unit 90, and fetches those measurement results (step S30). The reflected light measurement results have a voltage waveform like that shown in FIG. 7, for example.

When the reflected light measurement results are fetched, the residual volume determining unit 42 determines on the ink cartridge 100 for which to perform ink near end determination (hereafter referred to as the "cartridge subject to determination") (step S40). For example, in the sequence ink cartridge IC1 to IC4 shown in FIG. 6, the residual volume determining unit 42 determines on the cartridge subject to determination. When the cartridge subject to determination is determined, the residual volume determining unit 42 compares the output voltage of the detection unit 90 corresponding to, of the measurement results fetched at step S30, the measurement results of the reflected light from the prism 170 the cartridge subject to determination is equipped with, and the threshold value corresponding to the cartridge subject to determination among the threshold values determined for each ink cartridge 100 with the threshold value determining process of step S20 (step S50).

As a result of this comparison, when the output voltage from the detection unit 90 corresponding to the measurement results of the reflected light from the prism 170 the cartridge subject to determination is equipped with is lower than the threshold value corresponding to the cartridge subject to determination, the residual volume determining unit 42 determines that cartridge subject to determination to be "ink near end" (step S60). Meanwhile, when the output voltage from the detection unit 90 is higher than the threshold value corresponding to the cartridge subject to determination, the residual volume determining unit 42 determines that cartridge subject to determination as "has ink" (step S70).

In this way, when the determination has ended of whether the cartridge subject to determination is at ink near end, the residual volume determining unit 42 judges that the ink near end determination was performed for all the ink cartridges 100 (step S80). As a result, if the determination of whether ink near end has ended for all the ink cartridges 100 subject to determination, the residual volume determining unit 42 displays the residual state (whether ink near end or not) of each ink cartridge 100 on the display panel 70 that the printing device 10 is equipped with or on the computer 60 connected to the printing device 10 (step S90). In contrast to this, when determination of whether ink near end has not ended for all the ink cartridges 100 subject to determination, the process returns to step S40, and determination of whether ink near end is performed for the other ink cartridges 100.

With the ink near end detection process described above, each time the ink near end detection process is executed, the emitted light volume determining process and the threshold value determining process are executed. However, it is also possible to execute the emitted light volume determining process and the threshold value determining process at different timing from the ink near end detection process. For example, the emitted light volume determining process and the threshold value determining process can be executed one time each after the power of the printing device 10 is turned on or immediately after the ink cartridge 100 is replaced, and after that, while the power supply of the printing device 10 is on, the ink near end detection process from step S30 and thereafter can be executed a plurality of times along with estimation of the ink residual volume by the residual volume estimating unit 48 or with execution of printing.

C. Emitted Light Volume Determining Process

Figure 9:
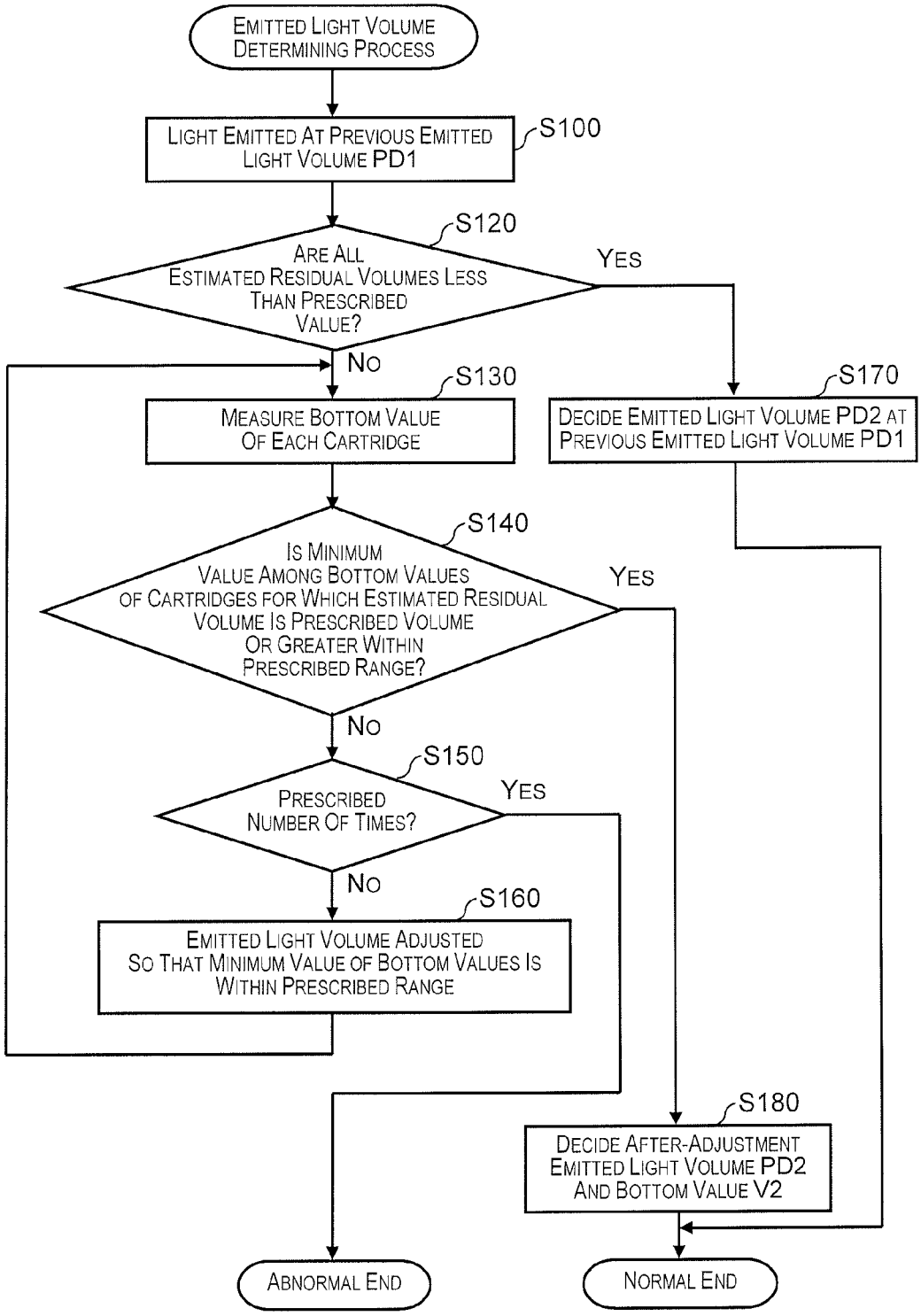
FIG. 9 is a detailed flow chart of the light emission volume determining process.

FIG. 9 is a detailed flow chart of the emitted light volume determining process executed at step S10 of the ink near end detection process shown in FIG. 8. This emitted light volume determining process is a process for adjusting the emitted light volume of the light emitting unit 92 based on the light volume of the light reflected by the bottom surface of the prism 170. When this emitted light volume determining process starts, the emitted light volume determining unit 44 first sets the emitted light volume to the emitted light volume determined by the previous emitted light volume determining process, specifically, to the emitted light volume PD1 fetched from the storage device 151 at step S5 in FIG. 8, and the control unit 40 starts light emission of the light emitting unit 82 at that emitted light volume PD1 (step S100). Note that for example, when the emitted light volume determined with the previous emitted light volume determining process was not fetched from the storage device 151 or the like, it is possible to set the emitted light volume of light emitted by the light emitting unit 92 to the maximum emitted light volume of the light emitting unit 92.

Next, the emitted light volume determining unit 44 judges whether or not the estimated residual volume of all the ink cartridges 100 are less than a prescribed volume based on the estimated residual volume fetched at step S5 in FIG. 8 (step S120). In other words, at step S120, a judgment is made of whether all the ink cartridges 100 are estimated to be at ink near end. If it is judged that the estimated residual volume of all the ink cartridges 100 are not less than a prescribed volume (in other words, if all the ink cartridges 100 are not estimated to be at ink near end), the emitted light volume determining unit 44 measures the minimum value (bottom value) of the output voltage of the detection unit 90 for each ink cartridge 100 while moving the carriage 20 in the main scan direction HD (step S130).

Figure 10:
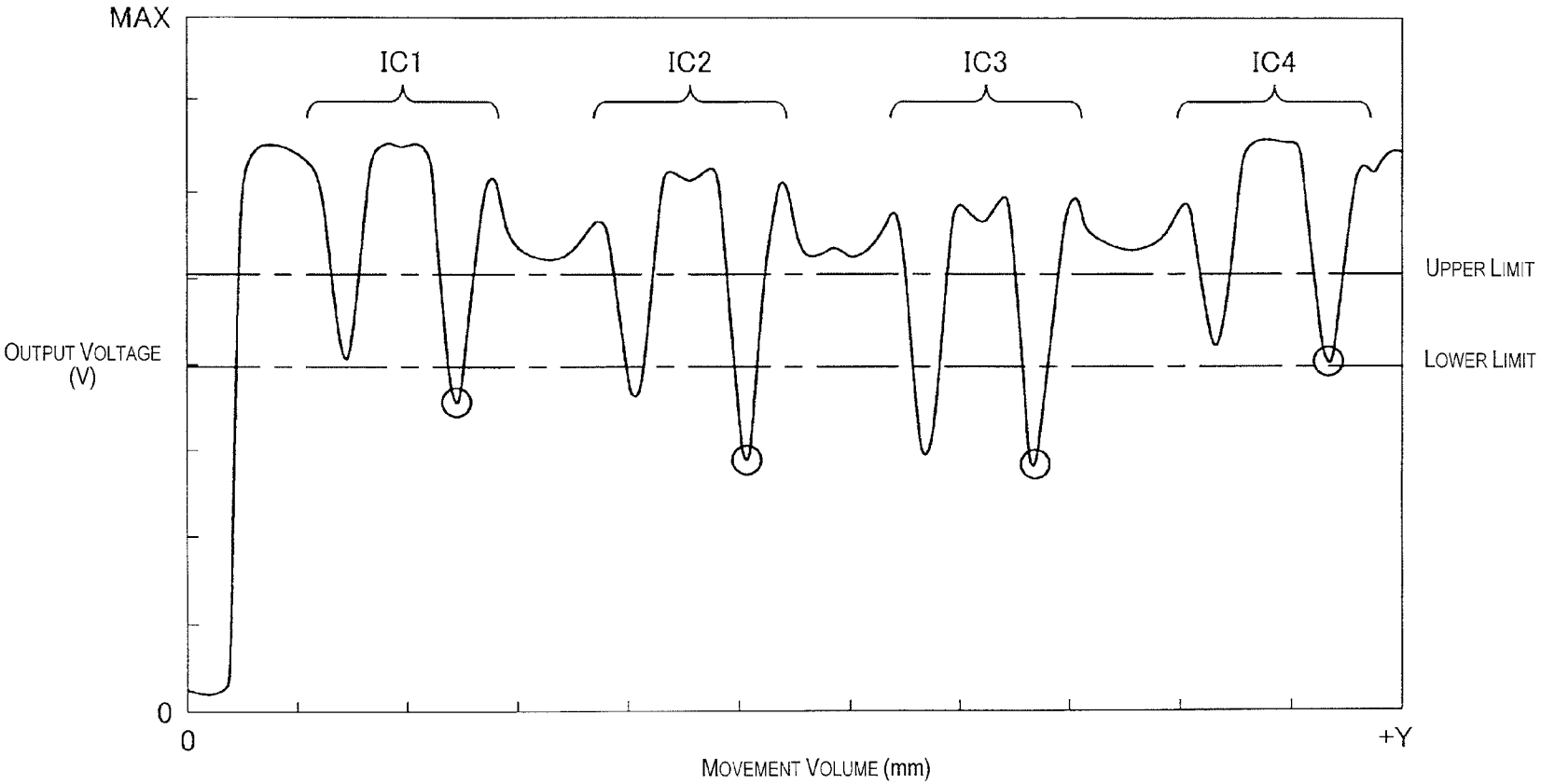
FIG. 10 is an explanatory drawing showing the bottom value for each ink cartridge.

FIG. 10 is an explanatory drawing showing the bottom value of each ink cartridge 100. As shown in FIG. 10, the bottom value of each ink cartridge 100 is the value that is the smaller of the values among the circle marks shown at two locations each for each ink cartridge 100 in FIG. 7. With step S130, the light volume of the reflected light from the prism 170 received by the light receiving unit 94 for each ink cartridge 100 is measured, and the output voltage value of the detection unit 90 when the reflected light from the bottom surface or the inclined surface of the prism 170 is at its largest is measured as the bottom value of that ink cartridge 100.

When the bottom value is measured for each ink cartridge 100, the emitted light volume determining unit 44 judges whether the bottom value with the lowest value among the bottom values of the ink cartridges 100 for which the estimated residual volume is a prescribed volume or greater (in other words, ink cartridges 100 estimated to have ink) is within a prescribed voltage range (step S140). FIG. 10 shows the upper limit and the lower limit indicating that voltage range. This voltage range is set by finding in advance through experimentation the voltage range such that the output voltage of the detection unit 90 can be distinguished by when the ink volume has gone below ink near end and when there is ink. At step S140, the reason that the ink cartridges 100 for which the estimated residual volume is less than a prescribed volume are excluded (in other words, the ink cartridges 100 for which ink near end is estimated) is because for example with the ink cartridge 100 such as the ink cartridge IC1 shown in FIG. 6, the ink level is likely to have gone below the part at which light is radiated from the light emitting unit 92 among the inclined surfaces of the prism 170, and in that kind of state, it is not possible to measure the light volume of the light directly reflected by the bottom surface of the prism 170.

At step S140, if the bottom value with the lowest value among the bottom values of the ink cartridges 100 for which the estimated residual volume is a prescribed volume or greater (in other words, the ink cartridges 100 estimated to have ink) is judged to be within a prescribed voltage range, the emitted light volume by the light emitting unit 92 is a suitable emitted light volume for detection of ink near end. Thus, the emitted light volume determining unit 44 determines the current emitted light volume as a new emitted light volume PD2, and the bottom value of each ink cartridge 100 measured at step S130 is determined as the bottom value V2 adjusted by the new emitted light volume PD2 (step S180). Then, the control unit 40 turns off the light emitting unit 92 for which light was emitted at step S100.

At step S140, if the bottom value with the lowest value among the bottom values of the ink cartridges 100 for which the estimated residual volume is a prescribed volume or greater (in other words, ink cartridges estimated to have ink) is judged to not be within a prescribed voltage range, the emitted light volume determining unit 44 judges whether or not the adjustment of the emitted light volume by step S160 described later was performed a predetermined prescribed number of times (step S150). This prescribed number of times can be from several times to several dozen times, for example.

At step S150, if it is judged that the number of emitted light volume adjustments did not reach the prescribed number of times, the emitted light volume determining unit 44 adjusts the emitted light volume so that the bottom value with the lowest value among the bottom values of the ink cartridges for which the estimated residual volume is a prescribed volume or greater is within a prescribed range (step S160).

When the emitted light volume is adjusted at step S160, the emitted light volume determining unit 44 has the process return again to step S130 and performs the judgment of whether or not the bottom value with the lowest value among the bottom values of each ink cartridge for which ink near end is not estimated is within a prescribed range. At step S150, when it is judged that the emitted light volume adjustments have reached a prescribed count, the emitted light volume determining unit 44 judges that it is not possible to suitably perform adjustment of the emitted light volume, that emitted light volume determining process is ended as abnormal, and the light emitting unit 92 for which light was emitted at step S100 is turned off by the control unit 40. When that emitted light volume determining process ends abnormally, it is possible that the detection unit 90 has failed. Because of that, the control unit 40 displays on the display panel 70 an error indicating that an abnormality has occurred at the detection unit 90, for example.

At step S120, when it is judged that the estimated residual volume of all the ink cartridges 100 are less than the prescribed volume, all the ink cartridges 100 are estimated to be ink near end. In this case, the light receiving unit 94 has a high probability of receiving light reflected on the inclined surface 170*b* and the inclined surface 170*a* within the prism 170 (the light corresponding to the voltage shown by the dotted line in FIG. 7), so it is not possible to suitably perform adjustment of the emitted light volume. In light of that, in this case, the emitted light volume determining unit 44 determines the emitted light volume PD1 fetched at step S5 in FIG. 8, in other words, the emitted light volume PD1 determined when that emitted light volume process was executed the previous time and stored in the storage device 151 (emitted light volume PD1 fetched at step S5 in FIG. 8) as is as the new emitted light volume PD2 (step S170). Then, the control unit 40 turns off the light emitting unit 92 that was emitting light at step S100.

Figure 11:
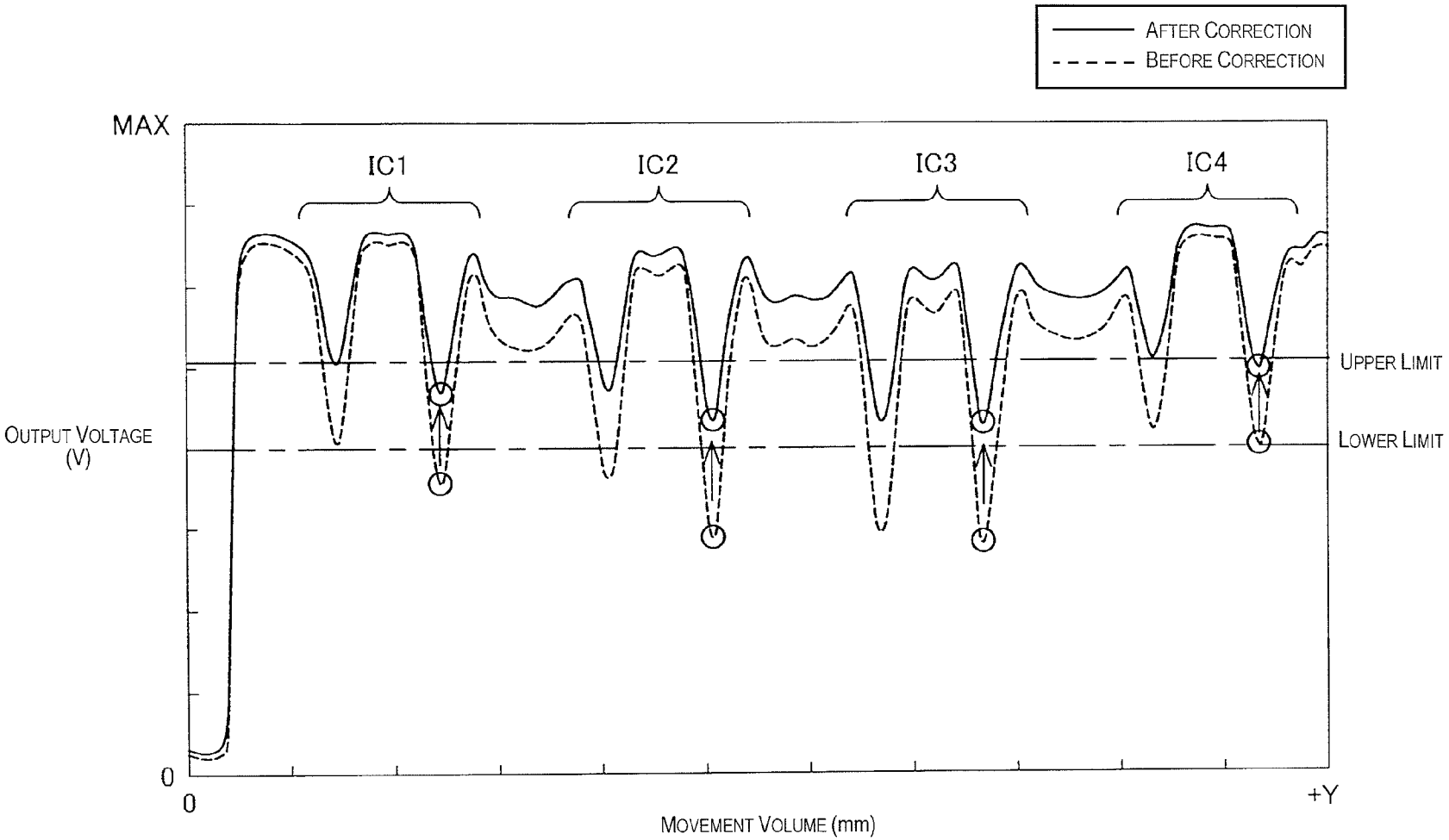
FIG. 11 is a drawing showing the output voltage of the detection unit after the emitted light volume was adjusted.

FIG. 11 is a drawing showing the output voltage of the detection unit 90 after the emitted light volume was adjusted by the emitted light volume determining process described above. The graph shown by the dotted line is the output voltage before adjustment, and the graph shown by the solid line is the output voltage after adjustment. With the emitted light volume determining process described above, as shown in this FIG. 11, it is possible to hold the bottom value with the lowest value among the bottom values of the ink cartridges 100 estimated to have ink within a prescribed voltage range. Because of that, for example, even in a case when the dirt or scratch state of the bottom surface of the prism 170 varies for each ink cartridge 100, the emitted light volume of the light emitting unit 92 can be adjusted uniformly to an emitted light volume for which it is possible to suitably detect ink near end. Because of that, even when the status of the dirtiness of the bottom surface of the prism 170 for each ink cartridge 100 is different, it is possible to determine ink near end with good precision.

Also, with the emitted light volume determining process described above, for the ink cartridges 100 estimated to be ink near end, the light volume of that reflected light is not used for adjustment of the emitted light volume. Because of that, it is possible to adjust the emitted light volume of the light emitting unit 92 to a suitable emitted light volume without being affected by strong light made incident from the prism 170 of the ink cartridge 100 which has reached ink near end.

Furthermore, with the emitted light volume determining process described above, when all the ink cartridges 100 are estimated to be ink near end, the emitted light volume of the light emitting unit 92 is adjusted to the emitted light volume determined by the previous emitted light volume determining process. Because of that, even in a case when all the ink cartridges 100 are estimated to be at ink near end, it is possible to suitably adjust the emitted light volume.

Also, after the emitted light volume determining process described above is executed, the finally determined emitted light volume is recorded in the storage device 151 of the ink cartridge 100. Because of that, for example, when the ink cartridge 100 is removed from the printing device 10 and mounted in another printing device, it is possible to convey a suitable emitted light volume for that ink cartridge 100 to the other printing device.

Also, with this embodiment, the light volume of the light directly reflected by the bottom surface of the prism 170 is measured using the fact that the light emitting unit 92 and the light receiving unit 94 have a certain level of directivity angle. Because of that, it is possible to improve the ink near end determination precision without using light emitting elements or light receiving elements with high directionality, so it is possible to reduce the cost of the printing device 10.

At step S140 of the emitted light volume determining process described above, the bottom value of the lowest value among the bottom values of the ink cartridges 100 estimated to have ink is judged as to whether or not it is within a prescribed voltage range. In contrast to this, it is also possible to judge whether a plurality of bottom values among the bottom values of the ink cartridges 100 estimated to have ink (e.g. all the bottom values) are within the prescribed voltage range, and to adjust the emitted light volume such that the plurality of bottom values is within the prescribed voltage range. By doing that, it is possible to hold the plurality of cartridge bottom values within the prescribed voltage range, so it is possible to adjust the emitted light volume to a more preferable emitted light volume.

D. Threshold Value Determining Process

Figure 12:
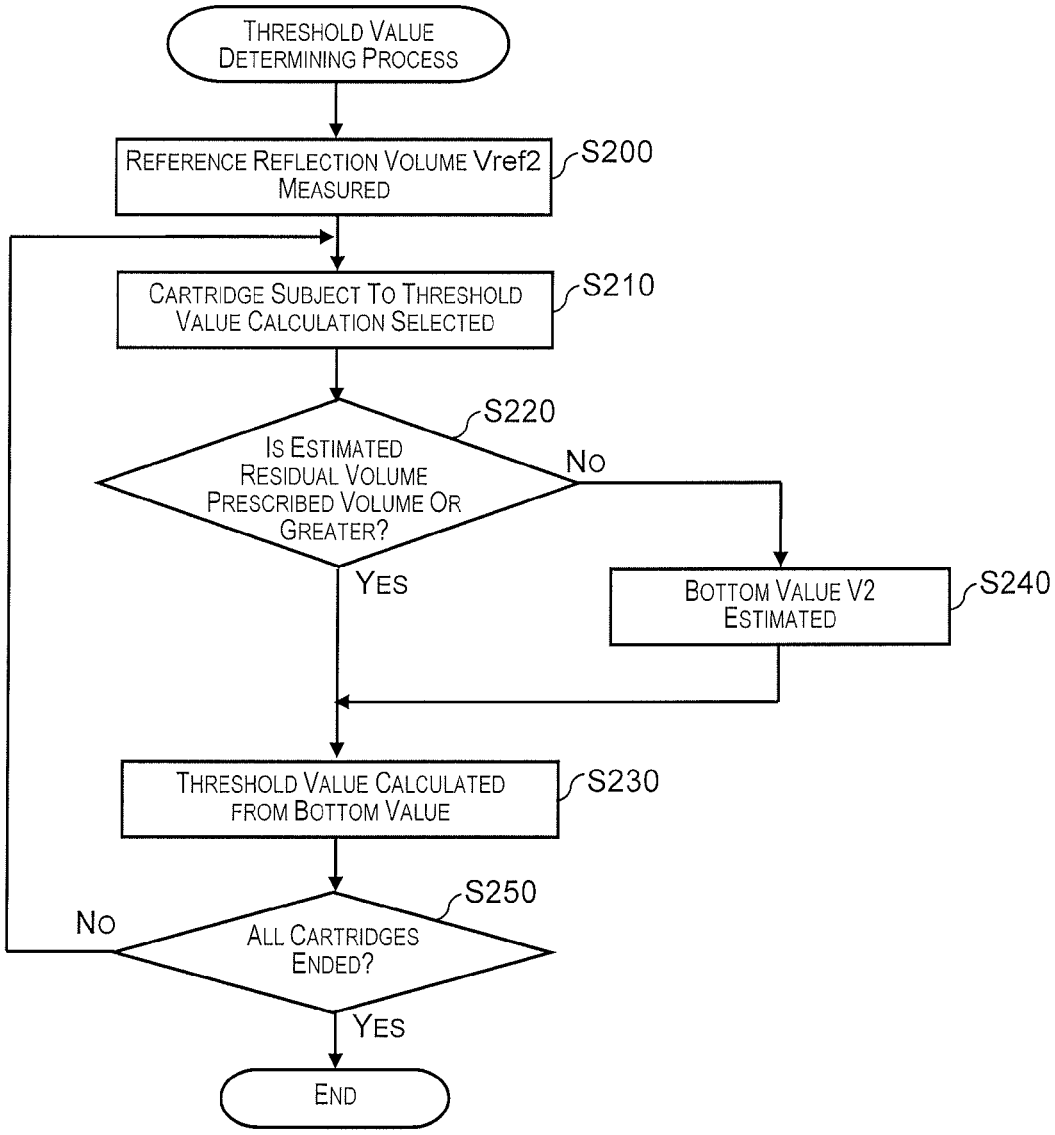
FIG. 12 is a detailed flow chart of the threshold value determination process.

FIG. 12 is a detailed flow chart of the threshold value determining process executed at step S20 of the ink near end detection process shown in FIG. 8. This threshold value determining process is a process for determining the threshold value for determining ink near end individually for each in cartridge 100 based on the light volume of the light reflected by the bottom surface of the prism 170.

When this threshold value determining process starts, the control unit 40 first moves the carriage 20 so that the reflection plate 81 is positioned above the detection unit 90, and using this reflection plate 81, measures the current reference reflection volume Vref2 (step S200). The reference reflection volume is the light volume of the reflected light from the reflection plate 81 in relation to a predetermined fixed emitted light volume.

When the reference reflection volume Vref2 is measured, the threshold value determining unit 46 selects one ink cartridge 100 that is subject to calculating of the threshold value (hereafter referred to as "cartridge subject to calculation" (step S210). The selection sequence can be the sequence of ink cartridges IC1 to IC4 shown in FIG. 6, for example.

When the cartridge subject to calculation is selected, the threshold value determining unit 46 judges whether or not the estimated residual volume of that cartridge subject to calculation is a prescribed volume or greater based on the estimated residual volume fetched at step S5 in FIG. 8 (step S220). When the estimated residual volume is judged to be a prescribed volume or greater, specifically, when the ink residual volume of the cartridge subject to calculating is estimated to "have ink," the threshold value determining unit 46 calculates the threshold value based on the bottom value V2 corresponding to the cartridge subject to calculation among the bottom values V2 determined by the emitted light volume determining process noted above (step S230). In specific terms, a value for which a prescribed value is subtracted from the bottom value V2 determined by the emitted light volume determining process noted above is determined as the threshold value. With this embodiment, the value subtracted from the bottom value V2 is a uniform value equivalent to 10 to 20% of the maximum output voltage of the detection unit 90. The maximum output voltage is the voltage of the power supply potential Vcc in FIG. 3. Note that the value subtracted from the bottom value V2 is not limited to being this kind of uniform value, and for example it is also possible to subtract a value for which the difference value from the maximum output voltage to the respective bottom values for each ink cartridge 100 is multiplied by a prescribed ratio.

At step S220, when the estimated residual volume of the cartridge subject to calculation is judged to be less than a prescribed volume, specifically, when the ink residual volume of the cartridge subject to calculation is estimated to be "ink near end," the threshold value determining unit 46 estimates the bottom value V2 corresponding to the light volume reflected by the bottom surface of the prism 170 of the cartridge subject to calculation (step S240). Calculation of the threshold value is performed based on this estimated bottom value V2 (step S230). When "ink near end" is estimated, the reason that the threshold value is not calculated based on the bottom value actually measured with the emitted light volume determining process noted above is that when at ink near end, strong light reflected by the inclined surface 170*b* and inclined surface 170*a* within the prism 170 is received by the light receiving unit 94, so the bottom value of the detection unit 90 is always shown near the minimum value, and it is not possible to suitably calculate the threshold value.

With step S230 noted above, the bottom value V2 of the cartridge subject to calculation is estimated using the formula (1) noted below based on the values (a) to (f) below.

(a) The current reference reflection value Vref2 measured at step S200

(b) The emitted light volume PD2 determined by the emitted light volume determining process noted above (c) The prior emitted light volume PD1 fetched at step S5 in FIG. 8

(d) The prior reference reflection volume Vref1 fetched at step S5 in FIG. 8

(e) The prior bottom value V1 fetched at step S5 in FIG. 8

(f) The maximum output voltage Vmax of the detection unit 90

$$V2 = V\max - (V\max - V1) * (PD2/PD1) * ((V\max - V\mathrm{ref}2)/(V\max - V\mathrm{ref}1)) \quad (1)$$

Using this formula (1), the value for which the rate of change of the emitted light of the light emitting unit 92 and the rate of change of the reference reflection volume (said another way, the rate of change over the years of the detection unit 90) are multiplied by the previously determined bottom value V1 is computed as the estimated value of the bottom value V2.

At the aforementioned step S230, when the calculation of the threshold value based on the bottom value V2 actual measurement value or estimated value has ended for the cartridge subject to calculation, the threshold value determining unit 46 judges whether the calculation of the threshold value has ended for all the ink cartridges 100 (step S250). If calculation of the threshold value has been completed for all the ink cartridges 100, that threshold value determining process ends, and if it has not been completed, the threshold value determining unit 46 returns the process to step S210, and continues calculation of the threshold value for the remaining ink cartridges 100.

Figure 13:
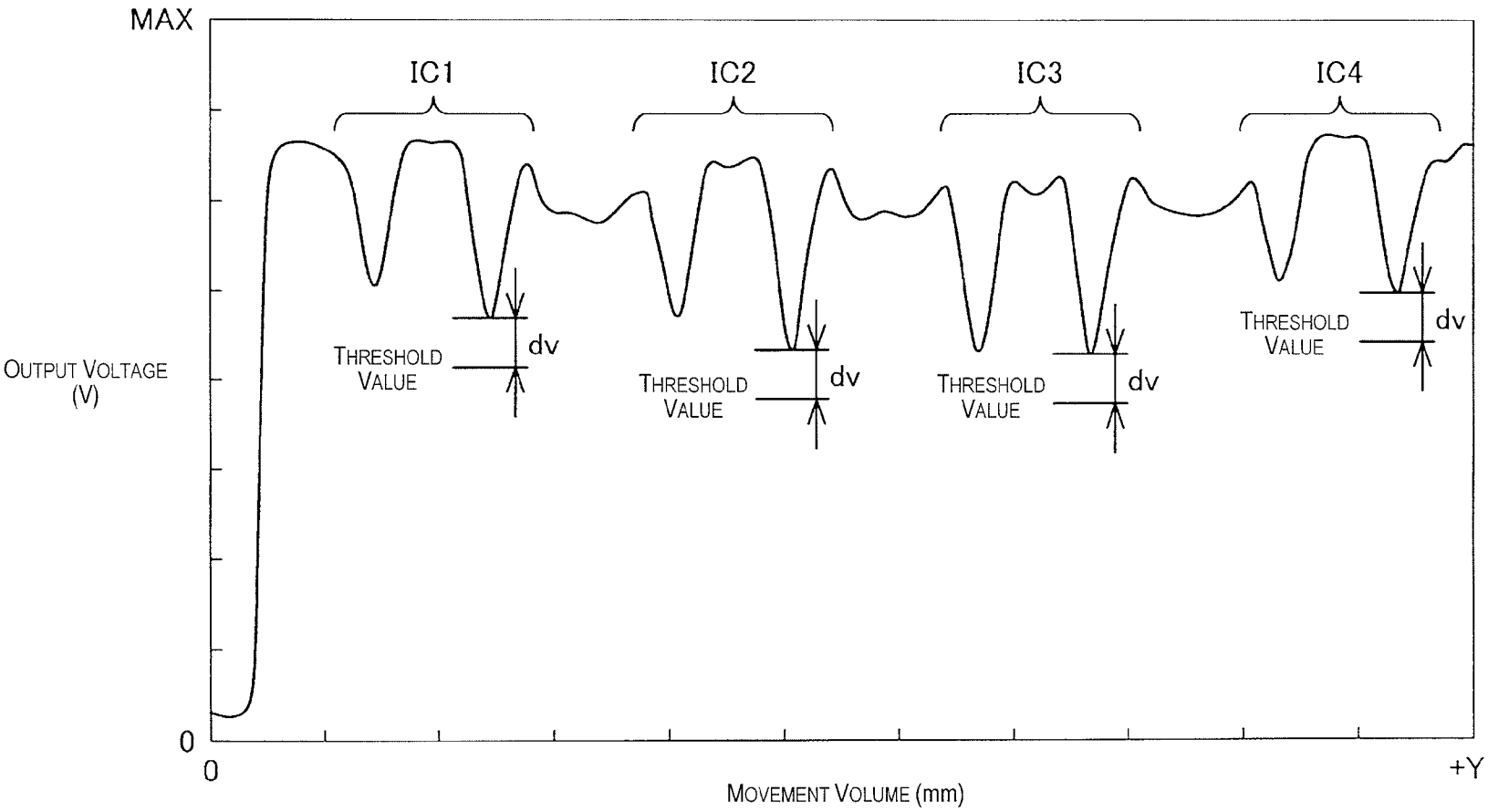
FIG. 13 is a drawing showing the threshold value for each cartridge.

FIG. 13 is a drawing showing the threshold value for each ink cartridge 100 determined by the threshold value determining process described above. With the threshold value determining process described above, as shown in FIG. 13, a voltage lower by a uniform fixed voltage dv from the respective bottom amount is determined for each ink cartridge 100 as the threshold value for determining ink near end. Because of that, for example even in a case when the light volume of the reflected light by the bottom surface differs for each prism 170 of the ink cartridge 100 because of ink mist adhering or scratches on the bottom surface of the prism 170, it is possible to suitably set a threshold value for performing determination of ink near end for each ink cartridge 100. In other words, it is possible to set a threshold value for determining ink near end for each ink cartridge 100 so as to follow the status of the dirtiness of the bottom surface of the prism 170 of each ink cartridge which can be replaced with differing timing. Because of that, it is possible to improve the ink near end determination precision.

Also, with the threshold value determining process described above, the emitted light volume by the light emitting unit 92 is fixed, and ink near end is determined by individually setting the threshold value for each ink cartridge. Because of that, it is not necessary to switch the emitted light volume of the light emitting unit 82 side because of following the dirtiness of the bottom surface of each prism 170, so it is possible to determine ink near end quickly while moving the carriage 20.

Also, with the threshold value determining process described above, for ink cartridges estimated to have ink, the threshold value is calculated based on the actually measured bottom value, and for ink cartridges estimated to be ink near end, the threshold value is calculated based on the estimated bottom value. Because of that, from the start, in the case of ink near end, it is not possible to accurately measure the reflected volume by the bottom surface of the prism 170, but with the threshold value determining process described above, regardless of whether or not there is ink, it is possible to suitably set a threshold value for determining ink near end.

Furthermore, with the threshold value determining process described above, even in cases when it is not possible to accurately measure the reflected light volume by the bottom surface of the prism (in other words, even in cases when ink near end is estimated), by multiplying the light emitting unit 92 emitted light volume rate of change and the reference reflection volume rate of change by the previously measured bottom value, it is possible to estimate the current reflected light volume bottom value with good precision. Because of that, it is possible to suppress erroneous determination such as it being determined that there is ink despite there not being ink inside the ink cartridge 100.

E. Modification Examples

Above, we described embodiments of the present invention, but the present invention is not limited to this kind of embodiment, and it is possible to use various constitutions in a range that does not stray from its gist. For example, the following kinds of modifications are possible.

Modification Example 1

With the threshold value determining process shown in FIG. 12, the threshold value is calculated based on the bottom value corresponding to the emitted light volume determined by the emitted light volume determining process. In contrast to this, for example, it is also possible to have the emitted light volume of the light emitting unit 90 be set so that the output voltage of the detection unit 90 according to the reflected light from the reflection plate 81 is a predetermined voltage, and to measure the bottom value corresponding to that emitted light volume and calculate the threshold value. In other words, it is also possible to have the bottom value determined by the emitted light volume determining process and the bottom value that is the threshold value calculation reference for the threshold value determining process be different bottom values.

Modification Example 2

With the embodiments noted above, the light blocking mask 50 is provided at the center part of the bottom surface of the prism 170, but the light blocking mask 50 can also be omitted. In this case, the bottom value shown in FIG. 7 can be at one location rather than at two locations for each ink cartridge 100.

Modification Example 3

With the embodiments noted above, the greater the received volume of light, the lower voltage that the detection unit 90 outputs. In contrast to this, it is also possible to have the detection unit 90 output a higher voltage the greater that the received light volume is. In this case, it is possible to read all of the "bottom values" described as the lowest output voltage of the detection unit 90 with the embodiments described above to "peak values" that are the highest output voltage of the detection unit 90. Also, in this case, it is possible to express formula (1) noted above as in formula (1b) noted below.

$$V2=V1*(PD2/PD1)*(V\mathrm{ref}2/V\mathrm{ref}1) \quad (1b)$$

Modification Example 4

With the embodiments noted above, both the emitted light determining process shown in FIG. 9 and the threshold value determining process shown is FIG. 12 are performed. When only the emitted light volume determining process is performed, it is also possible for the threshold value for determining ink near end to be fixed at a predetermined value. Also, when only the threshold value determining process is performed, it is possible to have the emitted light volume of the light emitting unit 92 be fixed, or to adjust it using the reflection plate 81. When only the emitted light determining process is performed, it is not necessary to measure the reference reflection volume using the reflection plate 81, so it is possible to omit the reflection plate 81, making it possible to make the printing device 10 (carriage 20) more compact.

Modification Example 5

With the embodiments noted above, it was described that when a prescribed volume remains of the ink inside the ink cartridge 100, the light made incident on the prism 170 is absorbed by the ink. However, for example when the ink cartridge 100 is shaken or the like, air bubbles may adhere to the interface of the prism 170 and the ink. In that case, even the ink is filled inside the ink cartridge 100, light is reflected by the air bubbles, the output voltage from the detection unit 90 decreases, and there is the risk of erroneous determination that there is no ink. In light of that, with the emitted light volume adjustment process noted above, it is also possible to measure in advance the decrease volume of the output voltage of the detection unit 90 due to air bubbles, and to set the lower limit value within a voltage range such that that value falls within the previously described voltage range after adjustment of the emitted light volume. By doing this, even when air bubbles occur, it is possible to suitably adjust the emitted light volume of the light emitting unit 92.

Modification Example 6

Figure 14:
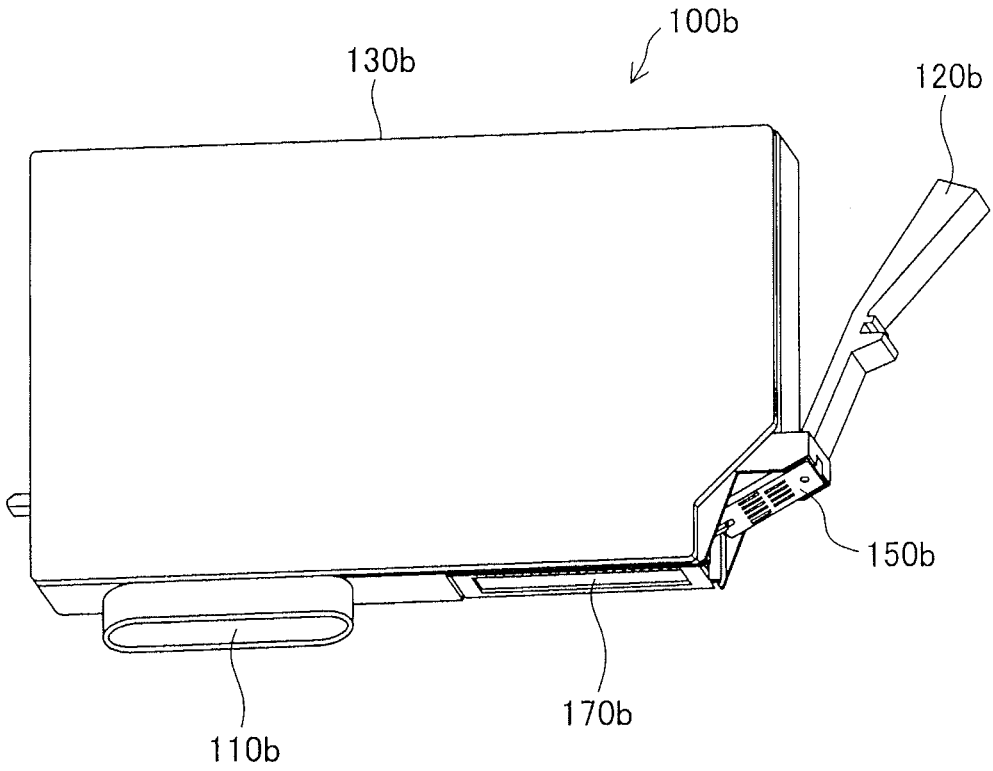
FIG. 14 is a drawing showing a modification example of the ink cartridge.

The mode of the ink cartridge 100 mounted in the printing device 10 is not limited to the mode shown in FIG. 4, and various modes can be used. FIG. 14 is a drawing showing a modification example of the ink cartridge. A substrate 150*b* is attached at an incline to the corner part of the bottom surface of the ink housing unit 130*b* on the ink cartridge 100*b* shown in this FIG. 14. Also, the prism 170*b* is provided on the lever 120*b* side at the bottom surface of the ink housing unit 130*b*. Also, the ink supply port 110*b* can also be formed in a roughly oval shape as shown in FIG. 14. For the mode of the carriage 20 as well, it is possible to make changes as appropriate to match the mode of the ink cartridge 100.

Modification Example 7

With the embodiments noted above, the ink residual state was determined by moving the carriage 20 back and forth over the detection unit 90, but it is also possible to move the detection unit 90 back and forth. In other words, it is sufficient to move the detection unit 90 and the carriage 20 back and forth relative to each other.

Modification Example 8

With the embodiments noted above, the emitted light volume determining process shown in FIG. 9 and the threshold value determining process shown in FIG. 12 were executed consecutively in this sequence. In contrast to this, the emitted light volume determining process and the threshold value determining process are not limited to this sequence, and as long as a conflict does not occur with the processing contents, it is also possible to execute these in the reverse sequence or to execute them simultaneously.

Modification Example 9

With the emitted light volume determining process and the threshold value determining process of the embodiments noted above, for ink cartridges 100 for which the estimated residual volume is less than a prescribed volume, these are handled as not being subject to adjustment of the emitted light volume or calculation of the threshold value. In contrast to this, even for ink cartridges 100 already determined to be at ink near end by the detection unit 90, it is also possible to handle these as not being subject to adjustment of the emitted light volume or calculation of the threshold value. It is possible to judge in the following manner whether or not ink near end has already been determined by the detection unit 90. Specifically, at step S60 of the ink near end detection process shown in FIG. 8, for ink cartridges 100 determined to be at ink near end, the control unit 40 records information indicating that ink near end has been determined in the storage device 151 of that ink cartridge 100. Then, when the printing device 10 power is on or the like, that information is read from the storage device 151 of each ink cartridge 100. Having done that, the control unit 40 is able to judge whether or not ink near end has already been determined by the detection unit 90 for each ink cartridge 100.

Modification Example 10

With the embodiments noted above, we described examples of the present invention being applied to printing devices and ink cartridges, but the present invention can also be applied to liquid consumption devices that spray or eject liquids other than ink, and also to the liquid containers housing that kind of liquid. Also, the liquid container of the present invention can be diverted for use for various types of liquid consumption devices equipped with liquid heads or the like that eject tiny liquid droplets.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid consumption device comprising:

a liquid container configured to supply liquid to the liquid consumption device;

a prism provided to the liquid container, and configured to receive light that is made incident from outside and to emit the incident light again toward the outside according to a liquid residual state inside the liquid container;

a light emitting unit configured to radiate the light to the prism;

a light receiving unit configured to receive the light emitted from the prism; and a control unit configured to control the light emitting unit to radiate the light, and to determine the liquid residual state based on a light volume of the light received by the light receiving unit, wherein, before the liquid residual state is determined, the control unit is configured to determine a threshold value of the liquid container that is used for determining the liquid residual state, and/or is configured to determine a light radiation volume by the light emitting unit, based on a light volume of reflected light that is reflected by an outer surface of the prism and received by the light receiving unit upon radiation of the light by the light emitting unit.

2. The liquid consumption device according to claim 1, further comprising a plurality of the liquid containers, wherein prisms are respectively provided in the plurality of liquid containers, and the control unit is configured to determine the light radiation volume by the light emitting unit based on a light volume of a plurality of reflected lights from the prisms that is received by the light receiving unit.

3. The liquid consumption device according to claim 2, wherein the control unit is configured to determine the light radiation volume by the light emitting unit based on a largest light volume among the light volumes of the plurality of reflected lights from the prisms.

4. The liquid consumption device according to claim 2, wherein the control unit is configured to estimate a residual volume of the liquid in each of the liquid containers, and to determine the light radiation volume from the light emitting unit based on the light volume of the reflected light from the prism equipped in the liquid container for which the estimated residual volume is a prescribed volume or greater.

5. The liquid consumption device according to claim 2, wherein the control unit is configured to estimate a residual volume of the liquid in each of the liquid containers, and to set the light radiation volume from the light emitting unit to the light volume determined previously when all the estimated residual volumes are less than a prescribed volume.

6. The liquid consumption device according to claim 1, wherein the liquid container includes a storage device, and after the light radiation volume from the light emitting unit is determined, the control unit is configured to write information indicative of the determined light radiation volume to the storage device.

7. The liquid consumption device according to claim 1, wherein the control unit is configured to determine the liquid residual state based on the light volume of the light received by the light receiving unit and on the threshold value.

8. The liquid consumption device according to claim 1, wherein the control unit is configured to estimate a residual volume of the liquid in the liquid container, and to determine the threshold value when the estimated residual volume is a prescribed volume or greater.

9. The liquid consumption device according to claim 1, wherein the liquid container includes a storage device, the control unit is configured to record the light volume of the reflected light received by the light receiving unit in the storage device, the control unit is configured to estimate a residual volume of the liquid in each of the liquid containers, the control unit is configured to estimate the light volume of the reflected light received by the light receiving based on a previous light volume of the reflected light recorded in the storage device when the estimated residual volume is less than a prescribed volume, and the control unit is configured to determine the threshold value based on the estimated light volume.

10. The liquid consumption device according to claim 1, wherein after the light radiation volume by the light emitting unit is determined, the control unit is configured to receive at the light receiving unit the reflected light reflected by the outer surface of the prism accompanying the light irradiation by the light emitting unit at the determined light radiation volume, and to determine the threshold value of the liquid container for determining the liquid residual state based on the light volume of the received reflected light.

11. The liquid consumption device according to claim 1, further comprising a plurality of the liquid containers, wherein prisms are respectively equipped in the plurality of liquid containers, the control unit is configured to determine the light radiation volume of light common to the plurality of liquid containers, and the control unit is configured to determine the threshold value of each of the liquid containers based on the light volume of the plurality of reflected lights received from the prisms.

12. A method for determining a liquid residual state for a liquid consumption device, wherein the liquid consumption device comprises:

a liquid container configured to supply liquid to the liquid consumption device;

a prism provided to the liquid container, and configured to receive light made incident from outside and to emit the incident light again toward the outside according to a liquid residual state inside the liquid container;

a light emitting unit configured to radiate the light to the prism; and a light receiving unit configured to receive the light emitted from the prism, wherein the method comprises:

radiating light on the light emitting unit, and determining the liquid residual state based on the light volume of the light received by the light receiving unit; and before the liquid residual state is determined, determining a threshold value of the liquid container that is used for determining the liquid residual state, and/or a light radiation volume by the light emitting unit, based on a light volume of reflected light that is reflected by an outer surface of the prism and is received by the light receiving unit upon radiation of the light by the light emitting unit.

* * * * *